US005399258A

United States Patent [19]

Fletcher et al.

[11] Patent Number: 5,399,258

[45] Date of Patent: Mar. 21, 1995

[54] HYDROCARBON UPGRADING PROCESS

[75] Inventors: David L. Fletcher, Turnersville; Michael S. Sarli, Haddonfield; Stuart S. Shih, Cherry Hill; Stephen J. McGovern, West Deptford Township, Gloucester, County; Douglas S. Diez, Deptford, all of N.J.; Mohsen N. Harandi, Longhorne, Pa.; Timothy L. Hilbert, Sewell, N.J.

[73] Assignee: Mobil Oil Corporation, Fairfax, Va.

[21] Appl. No.: 988,492

[22] Filed: Dec. 10, 1992

Related U.S. Application Data

[63] Continuation-in-part of Ser. No. 850,106, Mar. 12, 1992, which is a continuation-in-part of Ser. No. 745,311, Aug. 15, 1991.

[51] Int. Cl.[6] ..... C10G 45/00

[52] U.S. Cl. ..... 208/89; 208/212; 208/213

[58] Field of Search ..... 208/58, 135, 212

[56] References Cited

U.S. PATENT DOCUMENTS

| | | | |
|---|---|---|---|
| 3,758,403 | 9/1973 | Rosinski et al. | 208/120 |
| 3,759,821 | 9/1973 | Brennan et al. | 208/93 |
| 3,767,568 | 10/1973 | Chen | 208/134 |
| 3,769,202 | 10/1973 | Plank et al. | 208/111 |
| 3,894,107 | 7/1975 | Butter et al. | 260/668 R |
| 3,894,931 | 7/1975 | Nace et al. | 208/73 |
| 3,923,641 | 12/1975 | Morrison | 208/111 |
| 3,957,625 | 5/1976 | Orkin | 208/211 |
| 4,049,542 | 9/1977 | Gibson et al. | 208/213 |
| 4,062,762 | 12/1977 | Howard et al. | 208/211 |
| 4,309,279 | 1/1982 | Chester et al. | 208/120 |
| 4,738,766 | 4/1988 | Fischer et al. | 208/68 |
| 4,740,292 | 4/1988 | Chen et al. | 208/120 |
| 4,753,720 | 6/1988 | Morrison | 208/135 |
| 4,827,067 | 5/1989 | Kokayeff et al. | 208/212 |
| 4,911,823 | 3/1990 | Chen et al. | 208/67 |
| 5,143,596 | 9/1992 | Maxwell et al. | 208/89 |

*Primary Examiner*—Helane Myers

*Attorney, Agent, or Firm*—Alexander J. McKillop; Malcolm D. Keen; Jessica M. Sinnott

[57] ABSTRACT

Low sulfur gasoline of relatively high octane number is produced from a catalytically cracked, sulfur-containing naphtha by hydrodesulfurization followed by treatment over an acidic catalyst under endothermic conditions in a second reaction zone. Heat is added to the endothermic reaction zone to initiate and maintain octane restoring reactions. The preferred acidic catalyst is an intermediate pore size zeolite such as ZSM-5. The treatment over the acidic catalyst in the second step restores the octane loss which takes place as a result of the hydrogenative treatment and results in a low sulfur gasoline product with an octane number comparable to that of the feed naphtha. The addition of heat at the second zone prolongs hydrodesulfurization catalyst life by allowing a lower hydrodesulfurization reactor temperature. The addition of heat also maximizes octane increase in the second zone.

28 Claims, 2 Drawing Sheets

HYDROCARBON UPGRADING PROCESS

CROSS REFERENCE TO RELATED APPLICATIONS

This application is a continuation-in-part of our prior application Ser. No. 07/850,106, filed on Mar. 12, 1992, pending which, in turn, is a continuation-in-part of our prior application Ser. No. 07/745,311, filed Aug. 15, 1991, pending all incorporated herein by reference in their entireties.

FIELD OF THE INVENTION

This invention relates to a process for the upgrading of hydrocarbon streams. It more particularly refers to a process for upgrading gasoline boiling range petroleum fractions containing substantial proportions of sulfur impurities.

An FCC naphtha is hydrodesulfurized and the hydrodesulfurized intermediate is subjected to octane increasing reactions in an endothermic reaction zone. Heat is supplied to the endothermic reaction zone to improve the process.

BACKGROUND OF THE INVENTION

Catalytically cracked gasoline forms a major part of the gasoline product pool in the United States. However, where the petroleum fraction being catalytically cracked contains sulfur, the products of catalytic cracking usually contain sulfur impurities which normally require removal, usually by hydrotreating, in order to comply with the relevant product specifications. These specifications are expected to become more stringent in the future, possibly permitting no more than about 300 ppmw sulfur in motor gasolines; low sulfur levels also result in reduced emissions of CO, $NO_x$ and hydrocarbons. In the hydrotreating of petroleum fractions, particularly naphthas, and most particularly heavy cracked gasoline, the molecules containing the sulfur atoms are mildly hydrocracked so as to release their sulfur, usually as hydrogen sulfide.

In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina. After the hydrotreating operation is complete, the product may be fractionated, or even just flashed, to release the hydrogen sulfide and collect the now sweetened gasoline. Although this is an effective process that has been practiced on gasolines and heavier petroleum fractions for many years to produce satisfactory products, it does have disadvantages.

Cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool, It contributes a large quantity of product at a high blending octane number. In some cases, this fraction may contribute as much as up to half the gasoline in the refinery pool.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

Various proposals have been made for removing sulfur while retaining the more desirable olefins. U.S. Pat. No. 4,049,542 (Gibson), for instance, discloses a process in which a copper catalyst is used to desulfurize an olefinic hydrocarbon feed such as catalytically cracked light naphtha. A process for converting aliphatic mercaptans to form light paraffins, olefins and $H_2S$ was proposed in U.S. Pat. No. 6,894,107 (Butter et al) in which the hydrocarbon conversions occur over a ZSM-5 catalyst.

In any case, regardless of the mechanism by which it happens, the decrease in octane which takes place as a consequence of sulfur removal by hydrotreating creates a tension between the growing need to produce gasoline fuels with higher octane number and - because of current ecological considerations—the need to produce cleaner burning, less polluting fuels, especially low sulfur fuels. This inherent tension is yet more marked in the current supply situation for low sulfur, sweet crudes.

Processes for treating catalytically cracked gasolines have been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

To increase their octane numbers, naphthas, including light and full range naphthas, may be subjected to catalytic reforming to convert at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Therefore, naphthas are usually pretreated by hydrotreating to reduce their sulfur content before reforming. The octane rating of reformate may be increased further by processes such as those described in U.S. Pat. Nos. 3,767,568 and 3,729,409 (Chen) in which the reformate octane is increased by treatment of the reformate with ZSM-5.

Aromatics are generally the source of high octane numbers, particularly very high research octane numbers and are therefore desirable components of the gasoline pool. They have, however, been the subject of severe limitations as a gasoline component because of possible adverse effects on the ecology, particularly with reference to benzene. It has, therefore, become desirable, as far as is feasible, to create a gasoline pool in which the higher octanes are contributed by the olefinic and branched chain paraffinic components, rather than the aromatic components.

We have demonstrated in our prior co-pending applications Ser. No. 07/850,106, filed on Mar. 12, 1992 and Ser. No. 07/745,311 filed on Aug. 15, 1991 that zeolite ZSM-5 is effective for restoring the octane loss which takes place when the initial naphtha feed is hydrotreated. When the hydrotreated naphtha is passed over the catalyst in the octane restoration step of the process, some components of the gasoline are cracked into lower boiling range materials, if these boil below the gasoline boiling range, there will be a loss in the yield of the gasoline product. If, however, the cracking products are within the gasoline range, a net volumetric yield increase occurs. To achieve this, it is helpful to increase the end point of the naphtha feed to the extent that this will not exceed the gasoline product end point or similar restrictions (i.e. $T_{90}$, $T_{95}$).

Catalytic cracking of hydrocarbons is a highly endothermic process requiring substantial quantities of heat at relatively high temperatures. For example, the cracking of $C_{12}$− fractions over a zeolite catalyst, such as that having the topology of ZSM-5, requires heat input of about 125 kCal per kilogram of feed (225 BTU per pound) ranging from about 117 to 139 kCal per kilogram of feed (210 to 250 BTU per pound) at a reaction temperature of about 300° to 900° F. (about 150° to 480° C). As described in Ser. No. 07/850,106, it is advantageous that the endothermic cracking reactions follow the hydrodesulfurization step, which is exothermic, because the exotherm of the hydrodesulfurization can be controlled to supply sufficient heat for the cracking reactions. However, this requires a degree of control over the hydrodesulfurization step which may not be entirely efficient from a manufacturing standpoint. Also, a higher exotherm can shorten the life of the hydrodesulfurization catalyst.

SUMMARY OF THE INVENTION

We have developed a process for catalytically desulfurizing cracked fractions in the gasoline boiling range to reduce sulfur to acceptable levels without substantially reducing the octane number. An initial hydrotreating step desulfurizes the feed, after which the desulfurized material is charged to an endothermic reaction zone to restore lost octane. Since endothermic processes take place with the absorption of heat, requiring high temperatures for initiation and maintenance, we provide a process for supplying heat to the endothermic reaction zone to facilitate the octane restoring reactions. The process will extend the hydrodesulfurization catalyst's life and facilitate control over the first and second reaction steps, which require different reaction conditions.

In favorable cases, the volumetric yield for the gasoline boiling range product is not substantially reduced and may even be increased so that the number of octane barrels of product produced is at least equivalent to the number of octane barrels of feed introduced into the operation. The process may be utilized to desulfurize light, heavy and full range naphtha fractions and maintain at least the original octane of the feed. This process obviates the need for reforming the bulk of the naphtha fractions and lessens the degree of reforming previously considered necessary. Since reforming generally implies a significant yield loss, this constitutes a marked advantage.

For purposes of this invention, the term "hydrotreating" is used as a general process term descriptive of the reactions in which a prevailing degree of hydrodesulfurization occurs.

Thus, the invention provides a process of upgrading a sulfur-containing feed fraction boiling in the gasoline boiling range which comprises the steps of:

contacting the sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst of acidic functionality to convert it to a product comprising a fraction boiling in the gasoline boiling range having a higher octane number than the gasoline boiling range fraction of the intermediate product; and providing heat to the second reaction zone to allow the temperature of the first reaction zone to be independent from the temperature of the second reaction zone. More specifically, heat is provided to maintain the temperature of at least a portion of the second reaction zone to at least the same temperature as the temperature of at least a portion of the first reaction zone.

Unless indicated otherwise, reactor temperatures refer to the average reactor temperature as determined by the average of the reactor inlet and reactor outlet.

DETAILED DESCRIPTION

Feed

Figure 1:
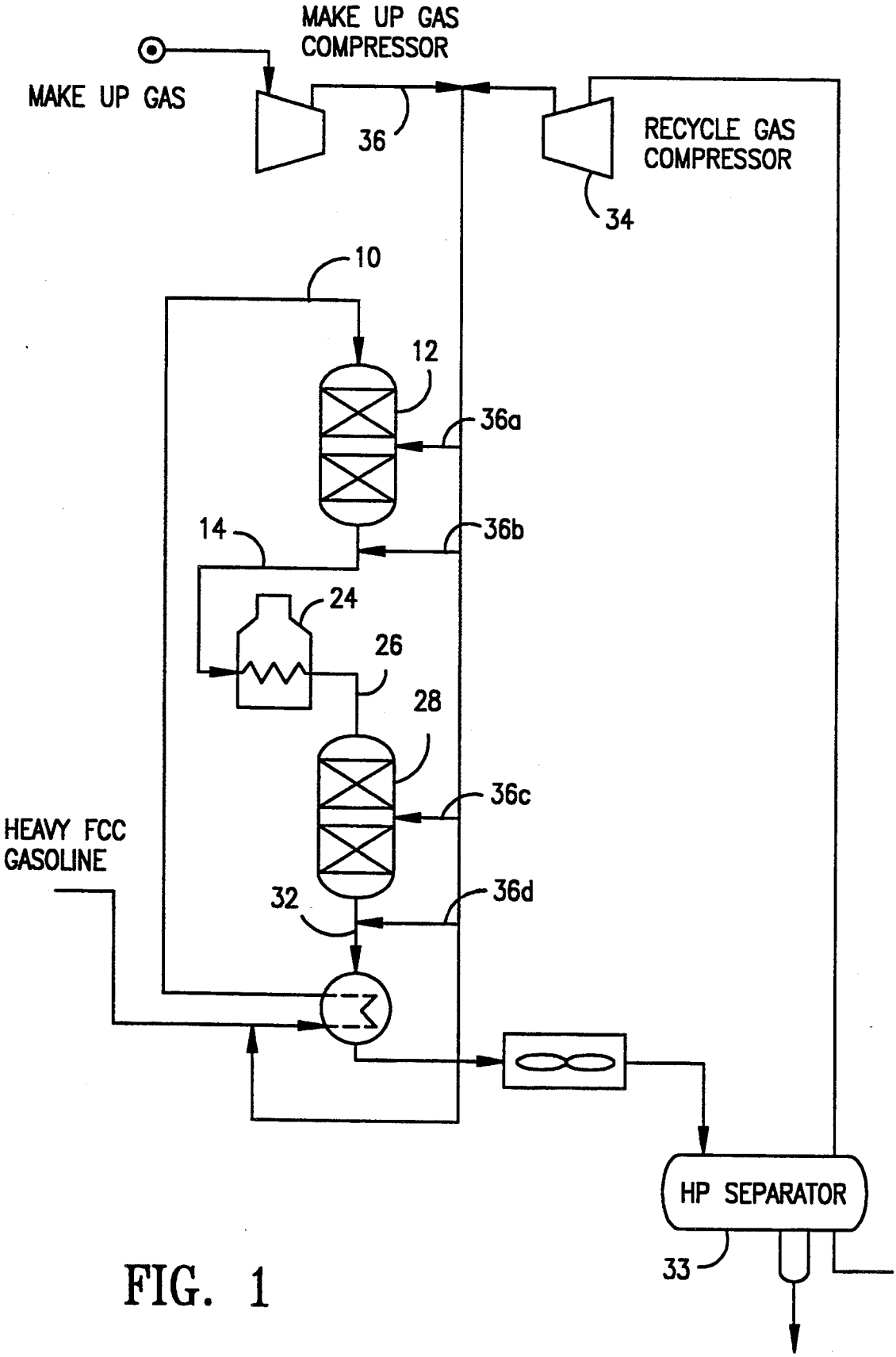
FIG. 1 is a simplified schematic flow diagram of the process of the present invention utilizing an interstage furnace heater.

The feed to the process comprises a sulfur-containing petroleum fraction which boils in the gasoline boiling range. Feeds of this type include light naphthas typically having a boiling range of about $C_6$ to 330 ° F., full range naphthas typically having a boiling range of about $C_5$ to 420 ° F., heavier naphtha fractions boiling in the range of about 260 ° F. to 412 ° F., or heavy gasoline fractions boiling at, or at least within, the range of about 330° to 500 ° F., preferably about 330° to 412 ° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as guard bed or Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Process Configuration

The selected sulfur-containing feed is treated in two steps by first hydrotreating the feed by effective contact of the feed with a hydrotreating catalyst in a first reaction zone. This hydrotreated intermediate product which boils in the gasoline boiling range (and usually has a boiling range which is not substantially different, and typically lower, than the boiling range of the feed), is then treated by contact with an acidic catalyst in a second reaction zone to produce a second product comprising a fraction which boils in the gasoline boiling range which has a higher octane number than the portion of the hydrotreated intermediate product fed to this second step.

The hydrodesulfurization reactions of the first reaction zone are exothermic and if the exotherm is high enough it can provide heat for the hydrocarbon upgrading reactions of the second reaction zone, which involves cracking, an endothermic reaction. For example, the hydrodesulfurization stage can be operated to produce a change in temperature ranging from about +1 ° F. to about +200 ° F., specifically from about +50 ° F. to about +150 ° F., more specifically +100 ° F. This contrasts with a change in temperature of the endothermic step which can range from about −25 ° F. to about −10 ° F. However, operating the hydrodesulfurization step to achieve high temperatures can lead to premature catalyst aging. Additionally, we found that high hydrodesulfurization temperatures, i.e. above about 700° to 750° F., encourage the production of mercaptans in the second stage. Thus, to rely on the hydrodesulfurization step to supply sufficient heat for the endothermic step is not always practical and can even be detrimental. Therefore, in accordance with this invention, at least a portion of the heat necessary for the reactions of the second zone is provided by an external heat source. The heat can be introduced by a heater, process furnace or a heat exchanger.

Heat Addition

The hydrodesulfurization is conducted in a first stage to produce a hydrodesulfurized intermediate product. Heat is added to at least a portion of the intermediate product to raise its temperature to a degree sufficient to facilitate cracking reactions in the second stage. Thereafter, the hot hydrodesulfurized intermediate is introduced to the second reaction zone to increase its octane. Interstage separation can be used to remove the inorganic sulfur and nitrogen as hydrogen sulfide and ammonia, respectively, as well the light ends (i.e., $C_5-$), however, this is not entirely necessary.

In one embodiment of the invention shown in FIG.1, heat is supplied from a process furnace. Referring to FIG. 1, an FCC naphtha is, preferably, passed through a heater (not shown) to achieve the desired reactor inlet temperature and is charged via line 10 to hydrodesulfurization zone 12 where it is contacted with a hydrodesulfurization catalyst. The hydrodesulfurized product is withdrawn via conduit 14 and, optionally, introduced to a separation zone (not shown) which facilitates separation of the inorganic sulfur and nitrogen. The hydrodesulfurized intermediate product is passed through process furnace 24. The temperature of the intermediate product stream is elevated to at least about 675 ° F. (357 ° C.), preferably ranging from about 700° F. to 800 ° F. (371 ° C. to 427 ° C.), even more preferably from 700 ° F. to 750 ° F. (371 ° C. to 399 ° C.). The heated intermediate stream is then withdrawn via line 26 and charged to the octane restoration zone 28, from which the octane restored product is withdrawn via line 32. Hydrogen recycle can be separated from the product in separator 33 and routed to gas compressor 34 for combination with makeup hydrogen 36 and distribution to various reaction zones via lines 36*a*, 36*b*, 36*c* and/or 36*d*. The hydrogen can be used as a quenching fluid to allow further separate control of the two stages. For example, in a quench operation, the first stage temperature is increased to overcome the effects of catalyst aging while a quenching fluid is introduced to the second stage to reduce the temperature that is increased by the higher temperature of the first stage. This mode can be used to reduce catalyst aging rate. Useful quenching fluids include liquid feed, liquid product or hydrogen treat-gas.

The heater firing rate controls the quantity of heat transferred to the process stream and this depends upon the temperature of the intermediate product introduced to the heater. That is, if interstage separation is not utilized then the intermediate feed stream will retain process heat from the exotherm of the hydrodesulfurization zone and this will be taken into consideration when adding heat. It will probably be most useful to establish a heater outlet temperature necessary for optimum conditions in the second reaction zone and this will enable the refiner to optimize conditions in the first stage for hydrodesulfurization. The heater can be an electric heater, coal or gas fired heater or any other practical heater.

Heat exchange operation by circulating an effective heat transfer medium through a heat exchanger positioned between the first and second reaction zones is also contemplated.

The heat transfer medium circulated through the heat exchanger can be any fluid suitable for carrying the heat necessary to impart a sufficient reaction temperature to the second reaction zone. Representative of suitable heat transfer media include water, in any phase; petroleum oil, in any phase; a molten salt such as $Na_2CO_3$, $NaNO_3$, $NaNO_2$ or $KN0_3$; synthetic fluid; or other known heat transfer fluid. Suitable heat transfer fluids, their advantages and disadvantages, are described in more detail in Kirk-Othmer, 12 *Encyclopedia of Chemical Technology*, pp 171–189 (1980) which is incorporated herein by reference.

Heat can be transferred to the heat transfer medium by heat exchange with appropriate process streams in an FCC (fluid catalytic cracking) unit such as FCC main column bottoms pump around, FCC regenerator, flue gas, spent catalyst or regenerated catalyst. In one embodiment, using heat exchange with the FCC unit, heat is transferred from an FCC regenerator to the second reaction zone via a heat exchanger.

Figure 2:
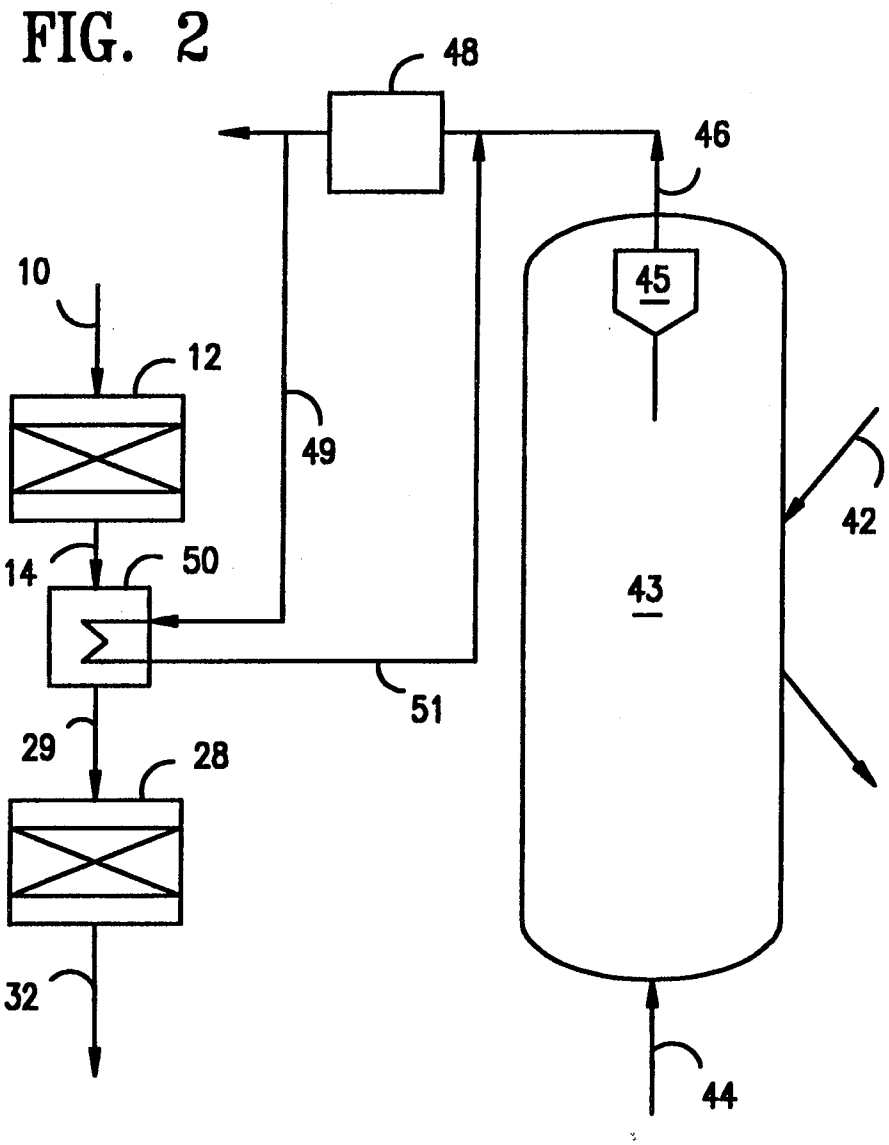
FIG. 2 is a simplified schematic diagram of the invention utilizing heat exchange with an FCC regenerator.

Referring to FIG. 2, deactivated cracking catalyst from an FCC reactor (not shown) flows through line 42 to regenerator vessel 43. Coke deposited on the catalyst burns in the presence of an oxidizing regenerating gas charged to the regenerator 43 via line 44. This yields substantially inert flue gas and regenerated cracking catalyst. The regenerated cracking catalyst leaves vessel 43 and enters cyclone separator 45, located inside vessel 43, in which flue gas and regenerated catalyst are separated. The flue gas flows out of vessel 43 through line 46 from which it is transported to a heat recovery unit 48.

A stream of heat transfer medium flows through line 49 and enters reactor heat exchanger 50 positioned upstream of octane restoration zone 28. The heat transfer medium flows through the reactor heat exchanger 50 and is cooled as thermal energy is transferred to the intermediate product introduced from the first reaction zone 12. From line 51 the cooled heat transfer medium is transported back to the heat recovery unit 48 for reheating. The heated feed is passed to the second reaction zone 28 via line 29.

Another heat source from the FCC unit is the thermal energy generated in cooling the heavy cycle oil (HCO) used in pump around operation during FCC product distillation.

Thermal energy generated from catalyst cooling can also be used as a heat source. In this embodiment, the hot FCC catalyst is cooled by a heat exchanger through which a cool heat transfer medium passes for heating. The heat transfer medium heated by the hot catalyst then passes to the second reaction zone heat exchanger. Although it may be difficult to employ, direct heat exchange can also be utilized in which the hot catalyst is circulated through the heat exchanger.

Heat can be added to the second stage by adding a hot feed to the intermediate product stream. The hot feed can be a reformate ranging in temperature from 700° F. to 900° F. or other hot stream, particularly a benzene-rich stream. The hot feed can be a light cut FCC gasoline in which a low sulfur, high olefin stream bypasses the first stage reactor and goes directly to the second stage reactor. The cut point for this stream is $C_5-170°$ F. or $C_5$ to 230° F. This light fraction will contain mercaptans which are expected to at least partially decompose over the catalyst of the second stage reactor (i.e. ZSM-5). Since $H_2S$ and olefin is an equilibrium reaction, partial recombination is expected. Alternatively, the heat from another exothermic reaction, the heat generated from a reaction of methanol to form gasoline (which can produce from 1250 to 2500 BTU/lb of energy), or alkylation of light olefins, i.e. $C_3-$, to form higher olefins, i.e. $C_6$ to $C_9$. In this case an alcohol, FCC flue gas or $C_5$-FCC olefin stream is introduced, along with the intermediate product, to the second stage. The reactions will produce sufficient heat to raise the temperature in the second stage.

Figure 3:
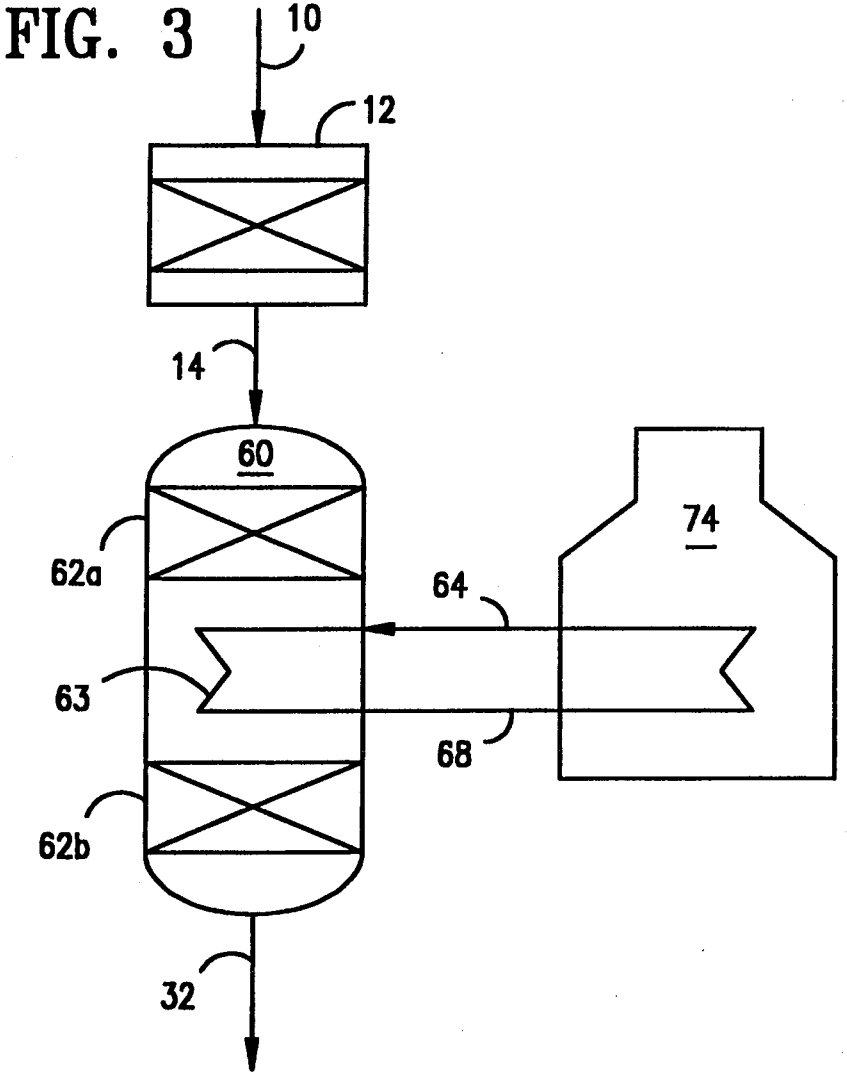
FIG. 3 is a simplified schematic flow diagram of the invention utilizing cascade operation with a heater located within the second reaction zone.

In an alternative embodiment shown in FIG. 3, the exotherm of the first reaction zone is used to advantage in cascade operation. In this process the heat from the rise in temperature of the first step is used to supply a portion of the heat necessary for the second step cracking reactions. However, a significant amount of the heat is supplied by a heat exchanger within the second reaction zone which provides and maintains the reactor temperature necessary to optimize the cracking reactions.

Referring to FIG. 3, cascade operation with a heat exchanger located within fixed bed reactor 60 of the second reaction zone is shown. The first reaction zone 12 in which hydrotreating occurs is located in front of fixed bed reactor 60 in which octane restoration occurs in regions 62*a* and 62*b*. Heat exchanger 63 is located between the first octane restoration region 62*a* and the second octane restoration region 62*b*. The hot hydrodesulfurized intermediate product flows from the first reaction zone 12 to reactor 60 for effective contact over a catalyst of acidic functionality. Because the temperature within reactor 60 lowers as thermal energy is absorbed during the endothermic reactions of the first octane restoration region 62*a*, heat is introduced via reactor heat exchanger 63. A stream of heated heat transfer medium enters the reactor heat exchanger 63 through conduit 64. After the heat transfer medium has accomplished effective transfer of thermal energy to the reaction, the cooled stream exits the heat exchanger 63 via conduit 68 and is returned to a high temperature heat source which can be a process furnace 74, as shown in FIG. 3, or other heat source. Then, the hot heat transfer medium circulates back to heat exchanger 63. In this way, the heat exchange adds heat to the octane restoration zone to facilitate cracking reactions.

Hydrotreating

The temperature of the hydrotreating step is suitably from about 400° to 850° F. (about 220° to 454° C.), preferably about 500° to 800° F. (about 260° to 427° C.), still more preferably no higher than about 700° F. to 770° F. (371° C. to 410° C.) with the exact selection dependent on the desulfurization desired for a given feed and catalyst. Adding heat to the second step allows a lower hydrotreating inlet temperature, ranging from about 450° F. to about 650° F. (232° C. to 343° C.) and more specifically temperatures in the range of 500° F. to 620° F. (260° C. to 327° C.). Control of the first stage exotherm is not critical when adding heat to the second step because the operator can optimize temperature requirements and other conditions in both the hydrodesulfurization zone and the octane restoration zone to maximize catalyst life, sulfur removal and octane boost.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to SCF/B (about 180 to 445 $n.l.l^{-1}$). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni—Mo or Co—Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an upflow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5-$), the conversion to $C_5-$ products is typically not more than 5 vol percent and usually below 3 vol percent and is normally compensated for by the increase which takes place as a result of aromatics saturation. An increase in volume is typical for the second step of the process where, as the result of cracking the back end of the hydrotreated feed, cracked products within the gasoline boiling range are produced. An overall increase in volume of the gasoline boiling range ($C_5+$) materials may occur.

Octane Restoration—Second Step Processing

After the hydrotreating step, the hydrotreated intermediate product is passed to the second step of the process in which cracking takes place in the presence of the acidic functioning catalyst. The addition of heat to the second step is accomplished as discussed above.

In an interstage operation, separation of the light ends at this point may be desirable, if the added complication is acceptable since the saturated $C_4$–$C_6$ fraction from the hydrotreater is a highly suitable feed to be sent to the isomerizer for conversion to iso-paraffinic materials of high octane rating; this will avoid the conversion of this fraction to non-gasoline ($C_5-$) products in the second stage of the process.

A process configuration with potential advantages is to take a heart cut, for example, a 195°–302° F. (90°–150° C.) fraction, from the first stage product and send it to the reformer where the low octane naphthenes which make up a significant portion of this fraction are converted to high octane aromatics. The heavy portion of the first stage effluent is, however, sent to the second step for restoration of lost octane by treatment with the acid catalyst. The hydrotreatment in the first stage is effective to desulfurize and denitrogenate the catalytically cracked naphtha which permits the heart cut to be processed in the reformer. Thus, the preferred configuration in this alternative is for the second stage to process the $C_8+$ portion of the first stage effluent and with feeds which contain significant amounts of heavy components up to about $C_{13}$ e.g. with $C_9$–$C_{13}$ fractions going to the second stage, improvements in both octane and yield can be expected.

The conditions used in the second step of the process are those which result in cracking of the desulfurized, hydrotreated effluent from the first step to restore the octane rating of the original, cracked feed at least to a partial degree. The reactions which take place during the second step are mainly the cracking of low octane paraffins to form higher octane products, both by the selective cracking of heavy paraffins to lighter paraffins and the cracking of low octane n-paraffins, in both cases with the generation of olefins. Some isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating×volume) of the final, desulfurized product may exceed the octane barrels of the feed.

The conditions used in the second step are those which are appropriate to produce this degree of cracking. Typically, the temperature of the second step will be about 300° to 900 ° F. (about 150° to 480° C.), preferably about 350° to 800 ° F. (about 177° to about 426° C.).

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$−) during the second stage is held to a minimum. However, because the cracking of the heavier portions of the feed may lead to the production of products still within the gasoline range, no net conversion to $C_5$− products may take place and, in fact, a net increase in $C_5$+ material may occur during this stage of the process, particularly if the feed includes significant amounts of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose are the intermediate pore size zeolitic behaving catalytic materials exemplified by those acid acting materials having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22. Zeolite MCM-22 is described in U.S. Pat. No. 4,954,325. Other catalytic materials having the appropriate acidic functionality may, however, be employed. A particular class of catalytic materials which may also be used are the large pores size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The catalyst should have sufficient acid activity to have cracking activity with respect to the second stage feed (the intermediate fraction), that is sufficient to convert the appropriate portion of this material as feed. One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 5, 527 (1965); 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina, titania or zirconia.

The catalyst used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable because it may tend to promote saturation of olefinics produced in the cracking reactions. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the second conversion catalyst will usually be determined by the type of conversion process which is being carried out, such as: a down-flow, liquid phase, fixed bed process; an upflow, fixed bed, liquid phase process; an ebulating, fixed fluidized bed liquid or gas phase process; or a liquid or gas phase, transport, fluidized bed process, as noted above, with the fixed-bed type of operation preferred.

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

Further increases in the volumetric yield of the gasoline boiling range fraction of the product, and possibly also of the octane number (particularly the motor octane number), may be obtained by using the $C_3$–$C_4$ portion of the product as feed for an alkylation process to produce alkylate of high octane number. The light ends from the second step of the process are particularly suitable for this purpose since they are more olefinic than the comparable but saturated fraction from the hydrotreating step. Alternatively, the olefinic light ends from the second step may be used as feed to an etherification process to produce ethers such as MTBE or TAME for use as oxygenate fuel components. Depending on the composition of the light ends, especially the paraffin/olefin ratio, alkylation may be carried out with additional alkylation feed, suitably with isobutane which has been made in this or a catalytic cracking process or which is imported from other operations, to convert at least some and preferably a substantial proportion, to high octane alkylate in the gasoline boiling range, to increase both the octane and the volumetric yield of the total gasoline product.

In one example of the operation of this process, it is reasonable to expect that, with a heavy cracked naphtha feed, the first stage hydrodesulfurization will reduce the octane number by at least 1.5, more normally at least about 3. With a full range naphtha feed, it is reasonable to expect that the hydrodesulfurization operation will reduce the octane number of the gasoline boiling range fraction of the first intermediate product by at least about 5, and, if the sulfur content is high in the feed, that this octane reduction could go as high as about 15.

The second stage of the process should be operated under a combination of conditions such that at least about half ($\frac{1}{2}$) of the octane lost in the first stage operation will be recovered, preferably such that all of the lost octane will be recovered, most preferably that the second stage will be operated such that there is a net gain of at least about 1 in octane over that of the feed, which is about equivalent to a gain of about at least about 5 based on the octane of the hydrotreated intermediate.

The process should normally be operated under a combination of conditions such that the desulfurization should be at least about 50%, preferably at least about 75%, as compared to the sulfur content of the feed.

Examples

The following examples illustrate the operation of the present process. In these examples, parts and percentages are by weight unless they are expressly stated to be on some other basis. Temperatures are in °F. and pressures in psig, unless expressly stated to be on some other basis.

Example 1

In the following example a heavy cracked naphtha, containing 2% sulfur, was subjected to processing as set forth below under conditions required to allow a maximum of only 300 ppmw sulfur in the final gasoline boiling range product. The properties of this naphtha feed are set out in Table 1 below.

TABLE 1

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R + O | 95.6 |
| Composition, wt % | |
| Paraffins | 12.9 |
| Cyclo Paraffins | 8.1 |
| Olefins and Diolefins | 5.8 |
| Aromatics | 73.2 |
| Distillation, ASTM D-2887, | °F./°C. |
| 5% | 289/143 |
| 10% | 355/179 |
| 30% | 405/207 |
| 50% | 435/224 |
| 70% | 455/235 |
| 90% | 482/250 |
| 95% | 488/253 |

Table 2 below sets out the properties of the catalysts used in the two operating conversion stages:

TABLE 2

| | Catalyst Properties | |
|---|---|---|
| | Hydrodesulfurization 1st stage Catalyst | ZSM-5[1] 2nd stage Catalyst |
| Composition, wt % | | |
| Nickel | — | 1.0 |
| Cobalt | 3.4 | — |
| $MoO_3$ | 15.3 | — |
| Physical Properties | | |
| Particle Density, g/cc | — | 0.98 |
| Surface Area, $m^2/g$ | 260 | 336 |

TABLE 2-continued

| | Catalyst Properties | |
|---|---|---|
| | Hydrodesulfurization 1st stage Catalyst | ZSM-5[1] 2nd stage Catalyst |
| Pore Volume, cc/g | 0.55 | 0.65 |
| Pore Diameter, A | 85 | 77 |

[1]65 wt % ZSM-5 and 35 wt % alumina

In the two cases illustrated here, in the second (ZSM-5) stage, the temperature was held constant at 700° F. (370° C.) while the HDS temperature was varied to either 350° F. (177° C.) or 550° F. (288° C.) at 0.84 LHSV (hr.$^{-1}$), hydrogen circulation rate of 3200 SCF/Bbl (570 n.l.l$^{-1}$.) hydrogen:oil, 600 psig (4220 kPa abs) pressure. The results are shown in Table 3 below.

Case 1 demonstrates the results of upgrading cracked naphtha with ZSM-5 without prior hydrotreatment. During the experiment, the temperature of the first reactor was 350° F., which is sufficiently low to make this stage hydrotreating ineffective and made this first stage merely a pre-heater. The second stage alone did not remove the required amount of sulfur.

In Case 2, mild hydrotreatment in the first stage did achieve the required desulfurization. However, the first stage of hydrotreatment completely saturated the olefins in the feed, as indicated by the bromine number reduction, and this resulted in a 9 number loss of research octane. The second stage processing over the ZSM-5 catalyst restored the lost octane.

TABLE 3

| Effect of Hydrotreating Severity on ZSM-5 Upgrading of FCC Naphtha | Case | |
|---|---|---|
| | 1 | 2 |
| Reactor 1 Temp., °F. | 350 | 550 |
| Reactor 2 Temp., °F. | 700 | 700 |
| Feed | | |
| Boiling Range, °F. | 95–500 | 95–500 |
| API Gravity | 54.3 | 54.3 |
| Sulfur, ppmw | 3800 | 3800 |
| Nitrogen, ppmw | 44 | 44 |
| Bromine No. | 45.81 | 45.81 |
| Research Octane | 93.5 | 93.5 |
| Motor Octane | 81.6 | 81.6 |
| Wt % $C_5$+ | 99.8 | 99.8 |
| Vol % $C_5$+ | 99.8 | 99.8 |
| Reactor 1 Product | | |
| Sulfur, ppmw | — | <20 |
| Nitrogen, ppmw | — | 3 |
| Bromine No. | — | 0.08 |
| Research Octane | — | 84.5 |
| Motor Octane | — | 76.8 |
| Wt % $C_5$+ | — | 99.3 |
| Vol % $C_5$+ | — | 96.2 |
| Vol % $C_3$ Olefins | — | 0.0 |
| Vol % $C_4$ Olefins | — | 0.0 |
| Vol % Isobutane | — | 0.0 |
| Potential Alkylate Vol % | — | 0.0 |
| Reactor 2 Product | | |
| Sulfur, ppmw | 1700 | 30 |
| Nitrogen, ppmw | 25 | <1 |
| Bromine No. | 12.70 | 1.40 |
| Research Octane | 94.0 | 90.0 |
| Motor Octane | 83.7 | 82.0 |
| Wt % $C_5$+ | 94.3 | 94.7 |
| Vol % $C_5$+ | 88.8 | 92.0 |
| Vol % $C_3$ Olefins | 0.5 | 0.2 |
| Vol % $C_4$ Olefins | 1.1 | 0.4 |
| Vol % Isobutane | 1.9 | 1.6 |
| Potential Alkylate vol % | 2.7 | 1.0 |

Example 2

A lower octane heavy naphtha fraction was treated to give a substantially desulfurized product with minimal octane loss. The sulfur compounds in this cracked naphtha were predominantly thiophenes and light mercaptans due to the nature of the cracking process. The cracked naphtha also contained a high concentration of olefins, which contributed substantially to the octane. The high olefin concentration was reflected in the high bromine number. The properties of this naphtha are shown in Table 4.

TABLE 4

| Heavy FCC Naphtha | |
|---|---|
| Boiling Range, °F. | 285–455 |
| API Gravity | 37.0 |
| Mercaptan Sulfur C2–C5, ppmw | 0 |
| Total Sulfur, ppmw | 3800 |
| Bromine Number | 40.62 |
| Nitrogen, ppmw | 51 |
| Research Octane | 89.1 |
| Motor Octane | 78.3 |

Table 5 sets out the properties of the catalysts used in the two conversion stages.

TABLE 5

| | Catalyst Properties | |
|---|---|---|
| | Hydrodesulfurization 1st stage Catalyst | ZSM-5[1] 2nd Stage Catalyst |
| Composition, wt % | | |
| Nickel | — | |
| Cobalt | 3.4 | — |
| $MoO_3$ | 15.3 | — |
| Physical Properties | | |
| Particle Density, g/cc | — | 0.929 |
| Surface Area, $m^2/g$ | 260 | 324 |
| Pore Volume, cc/g | 0.55 | 0.699 |
| Pore Diameter, A | 85 | — |

[1]contains 65 wt % ZSM-5 and 35 wt % alumina

In the three cases illustrated here, the temperature of the first stage was varied from 700° F. (370° C.) to 770° F. (410° C.) at a ratio of catalyst volumes used in the first and second stages of 1:2 by volume and operating conditions of 600 psig, space velocity of 0.67 LHSV and a hydrogen circulation rate of 2000 SCF/Bbl. Both stages of the process were carried out with direct cascade of the first stage effluent to the second stage, without interstage separation of the intermediate products of hydrogen sulfide and ammonia. The results of shown in Table 6.

TABLE 6

| Hydrodesulfurization and ZSM-5 Upgrading of Heavy FCC Naphtha | Case | | |
|---|---|---|---|
| | 1 | 2 | 3 |
| Stage 1 Temp., F. | 700 | 770 | 656 |
| Stage 2 Temp., F. | 700 | 700 | 737 |
| Feed | | | |
| Boiling Range, F. | 285–455 | 285–455 | 285–455 |
| API Gravity | 37.0 | 37.0 | 37.0 |
| Mercaptan Sulfur C2–C5, ppmw | 0 | 0 | 0 |
| Total Sulfur, ppmw | 3800 | 3800 | 3800 |
| Nitrogen, ppmw | 51 | 51 | 51 |
| Bromine Number | 40.62 | 40.62 | 40.62 |
| Research Octane | 89.1 | 89.1 | 89.1 |
| Motor Octane | 78.3 | 78.3 | 78.3 |
| Wt % C5+ | 100.0 | 100.0 | 100.0 |
| Vol % C5+ | 100.0 | 100.0 | 100.0 |

TABLE 6-continued

| Hydrodesulfurization and ZSM-5 Upgrading of Heavy FCC Naphtha | Case | | |
|---|---|---|---|
| | 1 | 2 | 3 |
| Stage 2 Product | | | |
| Mercaptan Sulfur $C_1$, ppmw | 4 | 19 | 25 |
| Mercaptan Sulfur C2–C5, ppmw | 52 | 72 | 62 |
| Total Sulfur, ppmw | 61 | 100 | 91 |
| Nitrogen, ppmw | <1 | <1 | <1 |
| Research Octane | 86.3 | 85.5 | 85.2 |
| Motor Octane | 78.3 | 77.3 | 76.4 |
| Wt % C5+ | 94.0 | 95.4 | 96.0 |
| Vol % C5+ | 95.2 | 96.8 | 97.1 |
| Vol % C3 Olefins | 0.3 | 0.4 | 0.5 |
| Vol % C4 Olefins | 0.7 | 0.9 | 0.6 |
| Vol % Isobutane | 2.6 | 1.6 | 1.3 |
| Potential Alkylate, vol %[1] | 1.8 | 2.2 | 1.9 |

[1]Potential alkylate defined as 1.7 × (C4= + C3=, vol %).

Cases 1 and 2 of Table 6 demonstrate the effect on the $C_2$–$C_5$ mercaptan concentration by varying the first stage hydrotreating temperature.

Generally the catalysts of each stage age at different rates, and separate temperature adjustments for the first and second stages maintain the objectives of each stage. Operating the first stage at a lower temperature meets desulfurization and denitrogenation requirements while avoiding the octane loss and rapid aging of the first stage catalyst as well as $C_2$ to $C_5$ mercaptan formation. Adding heat to the second stage to raise the temperature to a sufficient degree to initiate and maintain the cracking reactions allows a refiner to achieve the octane and yield desired in the final product.

We claim:

1. A process of upgrading a sulfur-containing catalytically cracked fraction having a 95% point of at least about 325° F. and boiling in the gasoline boiling range which comprises:

contacting the sulfur-containing catalytically cracked fraction having a 95% point of at least about 325° F. and boiling in the gasoline boiling range with a hydrodesulfurization catalyst in a first reaction zone, operating under a combination of elevated temperature, elevated pressure and an atmosphere comprising hydrogen, to produce an intermediate product comprising a normally liquid fraction high in paraffins which has a reduced sulfur content and a reduced octane number as compared to the feed;

contacting at least the gasoline boiling range portion of the intermediate product in a second reaction zone with a catalyst of acidic functionality under a condition of elevated temperature to convert it to a product high in olefins comprising a fraction boiling in the gasoline boiling range having a higher octane number than the gasoline boiling range fraction of the intermediate product; and providing sufficient heat to the second reaction zone to maintain the temperature of at least a portion of the second reaction zone to at least the same temperature as the temperature of at least a portion of the first reaction zone.

2. The process as claimed in claim 1 in which the step of providing heat further comprises raising the temperature of the intermediate product.

3. The process as claimed in claim 2 in which the temperature of at least the gasoline boiling range portion of the intermediate product is raised.

4. The process as claimed in claim 1 in which the heat is provided by a furnace.

5. The process as claimed in claim 1 in which the heat is provided by an FCC unit.

6. The process as claimed in claim 1 in which said heat is provided to raise the temperature of at least a portion of the second reaction zone above the temperature of at least a portion of the first reaction zone.

7. The process as claimed in claim 1 in which the temperature of at least a portion of the first reaction zone is no higher than 700° F. while the temperature of at least a portion of the second reaction zone is at least 700° F.

8. The process as claimed in claim 1 in which said feed fraction comprises a heavy naphtha fraction having a boiling range within the range of 200° to 500° F.

9. The process as claimed in claim 1 in which said feed fraction comprises a heavy naphtha fraction having a boiling range within the range of 200° to 412° F.

10. The process as claimed in claim 1 in which said feed fraction comprises a naphtha fraction having a 95 percent point of at least about 350° F.

11. The process as claimed in claim 10 in which said feed fraction comprises a naphtha fraction having a 95 percent point of at least about 380° F.

12. The process as claimed in claim 11 in which said feed fraction comprises a naphtha fraction having a 95 percent point of at least about 400° F.

13. The process as claimed in claim 1 in which the catalyst of acidic functionality comprises a zeolite having the topology of ZSM-5.

14. The process as claimed in claim 13 in which the zeolite is in the aluminosilicate form.

15. The process as claimed in claim 1 in which heat is provided to the second reaction zone by the addition of heat of an exothermic reaction.

16. The process as claimed in claim 15 in which the exothermic reaction is a reaction of methanol to form gasoline or alkylation of $C_3$ olefins.

17. A process of upgrading a sulfur-containing feed fraction boiling in the gasoline boiling range which comprises:

contacting the sulfur-containing feed fraction with a hydrodesulfurization catalyst in a first reaction zone, operating under a combination of elevated reactor temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst of acidic functionality to convert it, under endothermic conditions, to a product comprising a fraction boiling in the gasoline boiling range having a higher octane number than the gasoline boiling range fraction of the intermediate product; and providing sufficient heat to the second reaction zone to maintain the temperature of at least a portion of the second reaction zone above the temperature of the first reaction zone.

18. The process as claimed in claim 17 in which the heat is provided by a reactor heat exchanger.

19. The process as claimed in claim 17 in which the heat is provided by a hot FCC process stream.

20. The process as claimed in claim 19 in which the heat provided is transferred from an FCC flue gas, main column bottoms or heavy cycle oil pump-around stream.

21. The process as claimed in claim 17 in which the heat is provided by heat transfer from an FCC catalyst cooler.

22. The process as claimed in claim 17 in which the heat is provided by heating the intermediate product.

23. The process as claimed in claim 17 in which the heat is provided by heating the gasoline boiling range portion of the intermediate product.

24. A process of upgrading a sulfur-containing feed fraction boiling in the gasoline boiling range which comprises:

contacting the sulfur-containing feed fraction with a hydrodesulfurization catalyst in a first reaction zone, operating under a combination of elevated reactor zone outlet temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst of acidic functionality under a condition of elevated reactor zone inlet temperature to convert it to a product comprising a fraction boiling in the gasoline boiling range having a higher octane number than the gasoline boiling range fraction of the intermediate product;

providing sufficient heat to the second reaction zone to raise the temperature of the second reactor zone inlet above the temperature of the first reactor zone outlet.

25. A process of upgrading a sulfur-containing feed fraction boiling in the gasoline boiling range which comprises:

contacting the sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst of acidic functionality under a condition of elevated temperature to convert it to a product comprising a fraction boiling in the gasoline boiling range having a higher octane number than the gasoline boiling range fraction of the intermediate product;

controlling the octane of the product by providing heat to the second reaction zone;

maintaining the temperature of the second reaction zone above the temperature of the first reaction zone until the sulfur content of the intermediate product substantially increases in response to aging of the hydrodesulfurization catalyst;

elevating the temperature of the first reaction zone above the temperature of the second reaction zone to reduce the sulfur content of the intermediate product; and controlling the temperature of the second reaction zone by introducing a quenching fluid to the second reaction zone to avoid aging of the catalyst of the second reaction zone.

26. The process as claimed in claim 25 in which the quenching fluid is hydrogen, at least a portion of the product, at least a portion of the feed or at least a portion of the intermediate product.

27. The process as claimed in claim 25 in which the temperature of the first reaction zone is elevated above the temperature of the second reaction zone when the sulfur content of the intermediate product is more than 50% of the sulfur content of the feed.

28. The process as claimed in claim 1 in which the temperature of at least a portion of the first reaction zone ranges from about 600° F. to about 625° F. and the temperature of at least a portion of the second reaction zone ranges from about 700° F. to about 750° F.

* * * * *